US008915299B2

(12) United States Patent
Churchill

(10) Patent No.: US 8,915,299 B2
(45) Date of Patent: Dec. 23, 2014

(54) APPARATUS FOR USE IN TOP FILLING OF TUBULARS AND ASSOCIATED METHODS

(75) Inventor: Andrew Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 328 days.

(21) Appl. No.: 13/120,177

(22) PCT Filed: Sep. 18, 2009

(86) PCT No.: PCT/GB2009/002235

§ 371 (c)(1),
(2), (4) Date: Mar. 22, 2011

(87) PCT Pub. No.: WO2010/032018

PCT Pub. Date: Mar. 25, 2010

(65) Prior Publication Data

US 2011/0168397 A1 Jul. 14, 2011

(30) Foreign Application Priority Data

Sep. 22, 2008 (GB) ..... 0817307.2

(51) Int. Cl.
*E21B 21/00* (2006.01)
*E21B 21/01* (2006.01)
*E21B 17/00* (2006.01)

(52) U.S. Cl.
CPC ..... *E21B 21/01* (2013.01); *E21B 17/006* (2013.01); *E21B 21/00* (2013.01)
USPC ..... 166/312; 166/311; 175/314; 175/312; 175/206; 175/207

(58) Field of Classification Search
None
See application file for complete search history.

(56) References Cited

U.S. PATENT DOCUMENTS

| | | | | |
|---|---|---|---|---|
| 4,495,073 | A | 1/1985 | Beimgraben | |
| 5,433,279 | A * | 7/1995 | Tessari et al. | 173/213 |
| 6,976,546 | B2 * | 12/2005 | Herst | 175/57 |
| 2003/0217843 | A1 * | 11/2003 | Mullins | 166/90.1 |
| 2004/0079551 | A1 | 4/2004 | Herst | |
| 2007/0246210 | A1 * | 10/2007 | Richards | 166/56 |

FOREIGN PATENT DOCUMENTS

| | | | |
|---|---|---|---|
| GB | 2457317 | A | 8/2009 |
| WO | WO 2007144597 | A1 * | 12/2007 |

OTHER PUBLICATIONS

The Free Dictionary Online. The American Heritage Dictionary of the English Language, 2000, Houghton Mifflin Compnay, Update 2009. Fourth Edition.*
International Search Report—International Application No. PCT/GB2009/002235.
A Varco Training Manual dated Oct. 16, 1996.
Extracts from Varco TDS4 Top Drive Operator's Manual dated May 1990.
Extracts from Stena Drilling, Innovation and Performance Manual dated Jun. 25, 2010.

* cited by examiner

*Primary Examiner* — Jennifer H Gay
*Assistant Examiner* — Caroline Butcher
(74) *Attorney, Agent, or Firm* — Gifford, Krass, Sprinkle, Anderson & Citkowski, P.C.

(57) ABSTRACT

Apparatus (100) for use in top filling of tubulars comprising an inlet (200) for fluid communication with a top drive for providing top filling fluid, and an outlet (300) for fluid communication with a tubular. The apparatus (100) comprises a filter configuration (120), in fluid communication with the inlet (200) and the outlet (300) and configured to remove debris from a top filling fluid flow flowing from the inlet (200) to the outlet (300) during top filling of a tubular.

32 Claims, 2 Drawing Sheets

APPARATUS FOR USE IN TOP FILLING OF TUBULARS AND ASSOCIATED METHODS

CROSS-REFERENCE TO RELATED APPLICATIONS

This application is the U.S. national phase of PCT/GB2009/002235 filed Sep. 18, 2009, which claims priority of Great Britain Patent Application No. 0817307.2 filed Sep. 22, 2008.

TECHNICAL FIELD

The present invention relates to the field of apparatus for use in top filling of tubulars for drilling operations and associated methods. Certain embodiments of the invention relate to apparatus for removing debris from top filling fluid for tubulars and associated methods.

BACKGROUND

In the oil and gas industry, bores are drilled to access subsurface hydrocarbon-bearing formations. The bores are drilled using bits forming parts of bottom hole assemblies (BHAs) mounted on the ends of strings of drill pipe. A drill pipe string comprises a number of drill pipe lengths, which can be stored on surface as "stands". Each stand may comprise three or four lengths of drill pipe. As a drill string is advanced into a bore, new stands of pipe are added to the upper end of the string. As a bore advances, casing and/or completion tubing can be run into the bore in order to, for example, stabilise the bore. Casing, completion tubing, drill pipes, liners, and the like, are herein collectively referred to as "tubulars".

The drilled bore is typically filled with drilling fluid, mud or brine. Thus, as tubulars are lowered into the bore, the drilling fluid surrounds the tubular. Some tubulars are configured such that this drilling fluid may flow into the hollow tubular as it passes into the fluid-filled bore (so-called "self-filling" tubulars). However, in other circumstances the tubular is not self-filling and must be top-filled. For example, when the tubular is provided with a float, or non-return value. In the absence of fluid in the tubular, the external hydrostatic pressure may reach a level sufficient to crush or collapse the hollow tubular.

Conventionally, such tubulars will be top-filled by trickling drilling fluid into their open upper end. This top-filling operation is tricky and potentially messy, with spillage of drilling fluid being common. Also, top-filling tubulars can take a significant amount of time and it will often be required to clean-up any spills, particularly in the case of drill strings, as drill pipe ends often have a region of restricted cross-section. Furthermore, it has been identified that when contaminants or debris in top filling fluid are allowed to enter the tubulars, it can cause serious problems with subsequent operations, such as inhibiting mating of sealing faces of sections of completion tubings, etc. Accordingly, some operators require that top filling fluid is filtered as the fluid is trickled into the tubulars, which tends to create further delays.

PCT/GB2007/002172 (Churchill) discusses apparatus for top filling and is incorporated herein by reference.

SUMMARY

In a first aspect there is provided an apparatus for use in top filling of tubulars, the apparatus comprising an inlet for fluid communication with a top drive for providing top filling fluid, and an outlet for fluid communication with a tubular, wherein the apparatus comprises a filter configuration, in fluid communication with the inlet and the outlet and configured to remove debris from a top filling fluid flow flowing from the inlet to the outlet during top filling of a tubular.

The filter configuration may be substantially fluidly sealed with respect to the inlet and/or outlet. The apparatus may be configured such that the inlet is sealable with respect to a top drive. The apparatus may be configured to be pressurised (e.g. pressurised with top filling fluid during top filling).

The inlet may be configured for mounting/demounting with a top drive (e.g. a top drive for providing top filling fluid for top filling a tubular).

The inlet may comprise an inlet sealing element. The inlet sealing element may be configured to allow for mating of a top drive with the inlet (e.g. non-fixed mating). The inlet sealing element may be a screw/thread for complementary use with a thread/screw on a top drive. The inlet sealing element may be an gasket, such as an annular gasket.

The inlet sealing element (e.g. the annular gasket) may comprise a deformable material. The inlet sealing element may comprise a resiliently deformable material. The inlet sealing element may provide for the said fluidly sealing of the apparatus/inlet and top drive.

The inlet sealing element may comprise at least one of: an elastomer material; a rubber material; a silicon material. The provision of such material(s) may assist/improve sealing of the inlet with a top drive.

The inlet may comprise a tapered region. The tapered region may be configured to allow for ease of positioning of the inlet with respect to a top drive (i.e. a tapered region for locating with/within a saver-sub of a top drive).

The outlet may comprise a nozzle portion. The nozzle portion may comprise a nozzle. The nozzle may be configured to guide/direct top filling fluid into a tubular. The nozzle may be configured to have a reduced cross-sectional area when compared to the inlet. The nozzle may be configured to eject top filling fluid in a substantially longitudinal/axial direction relative to a tubular.

The outlet may be configured for mounting/demounting with a tubular for providing top filling fluid from the filter configuration/apparatus to a tubular.

The outlet may comprise an outlet contact element (e.g. an annular contact element/gasket). The outlet contact element may be configured to provide for mating (e.g. non-fixed mating) of the outlet and a tubular. The outlet contact element may comprise a deformable material. The outlet contact element may comprise a resiliently deformable material.

The outlet contact element may comprise at least one of: an elastomer material; a rubber material; a silicon material; steel. The provision of such material may assist/improve sealing of the outlet with a tubular.

The nozzle portion may further comprise at least one gas vent channel (i.e. such that the outlet, in use, is not sealed with a tubular). The at least one gas vent channel may be configured to allow vacating gas to exit a tubular/outlet when a tubular is being filled with top filling fluid from the outlet. The at least one gas vent channel may help to define the outlet contact element, or portion thereof.

The outlet may comprise a guide. The guide may be configured to guide vacating gas, vacating from a gas vent channel, outside a tubular in a downwardly parallel direction relative to the axial length of a tubular. The guide may be configured to be affixed to an edge region of the outlet. The guide may be detachable with the outlet (e.g. so as to be cleanable/replaceable). Alternatively/additionally, the guide may be configured to guide vacating gas, and any associated exiting material, to a container or receptacle.

The filter configuration may comprise a first filter region in fluid communication with the inlet and a second filter region in fluid communication with the outlet. The first filter region may be in fluid communication with the second filter region via a plurality of restrictive apertures.

The restrictive apertures may be configured to remove debris from a top filling fluid flow flowing from the inlet to the outlet. The restrictive apertures may be configured so that the cumulative cross-sectional area of the restrictive apertures is substantially the same, or greater, than the cross-sectional area of the inlet/first filter region.

The filter configuration/restrictive apertures may be configured such that the pressure of top filling fluid entering the first filter region is substantially the same as the pressure of the top filling fluid entering the outlet. The restrictive apertures may be configured so as not to restrict (unduly) the flow of top filling fluid to any extent.

The filter configuration, or portion thereof, may be configured as a trap for trapping of debris. The first filter region may be configured as a trap for trapping debris within the first filter region. The filter configuration/first filter region may be configured as an assessable trap to allow for the removal of debris (e.g. accessible by a user so as to allow for removal of trapped debris).

The apparatus may be configured to allow a user to insert their arm/hand into the first filter region so as to remove debris. The apparatus may be configured to allow a user to insert a tool into the first filter region so as to remove debris. The apparatus may be configured to allow a user to invert (tip upside down) the apparatus so as to facilitate removal of debris from the first filter region.

The first filter region may be removable from the apparatus. The removable first filter region may allow for easy removal of debris. The first filter region may be attachable/detachable with the inlet and/or second filter region. The first filter region may be replaceable. For example, replaceable so as to allow for the first filter region to be replaced when containing debris, and/or when eroded, corroded, ablated, etc.

Some or all of the restrictive apertures may be provided along a wall defining the first filter region. The restrictive apertures may extend evenly/unevenly in the direction that top filling fluid is intended to enter the first filter region (e.g. extend along a principal/axial length of a wall of the first filter region).

The apparatus may be configured such that flow of top filling fluid entering from the inlet is in substantially the same direction as flow exiting from the outlet (i.e. flow entering the apparatus is in substantially the same direction as flow exiting the apparatus).

The inlet may be attachable/detachable with the apparatus. The inlet may be attachable/detachable so as to allow access to the first filter region. The outlet may be attachable/detachable with the apparatus. The outlet may be attachable/detachable so as to allow access to the first filter region.

The apparatus may be configured such that the first filter region is retained between the inlet and outlet (e.g. held in position). The apparatus may be configured such that the inlet/outlet are detachable with the second filter region. The second filter region may define casing of the apparatus (e.g. an outer casing).

The tubular may be any one or more of: drill pipe; completion tubing; casing; liner.

According to a second aspect of the invention there is provided an inlet configured for attachable/detachable use with a filter configuration for removal of debris from a top filling fluid, the inlet configured for fluid communication with a top drive for providing top filling fluid and for fluid communication with a filter configuration, the inlet for use in top filling of a tubular.

The inlet may be configured for mounting/demounting with a top drive for providing top filling fluid to a filter configuration.

The inlet may comprise an inlet sealing element, such as an inlet gasket (e.g. an annular gasket). The inlet sealing element may be configured to allow for non-fixed mating of a top drive with the inlet. The inlet sealing element may be configured to allow for sealing of a top drive with the inlet. The inlet may comprise a tapered region. The tapered region may be configured to allow for ease of positioning of the inlet with respect to a top drive.

According to a third aspect of the invention there is provided an outlet configured for attachable/detachable use with a filter configuration for removal of debris from a top filling fluid, the outlet configured for fluid communication with a tubular for being provided with top filling fluid and for fluid communication with a filter configuration, the outlet for use in top filling of a tubular.

The outlet may be configured for mounting/demounting with a tubular for providing top filling fluid from the filter configuration/apparatus to a tubular.

The outlet may comprise a nozzle portion. The nozzle portion may comprise a nozzle. The nozzle may be configured to guide/direct top filling fluid into a tubular. The nozzle may be configured to have a reduced cross-sectional area when compared to the inlet.

The outlet may comprise an outlet contact element (e.g. an annular contact element/gasket). The outlet contact element may be configured to provide for mating (e.g. non-fixed mating) of the outlet and a tubular. The outlet contact element may comprise a deformable material. The outlet contact element may comprise a resiliently deformable material.

The outlet contact element may comprise at least one of: an elastomer material; a rubber material; a silicon material; steel. The provision of such material may assist/improve sealing of the inlet with a top drive.

The nozzle portion may further comprise at least one gas vent channel (i.e. such that the outlet is not sealed with a tubular). The at least one gas vent channel may be configured to allow vacating gas to exit a tubular/outlet when a tubular is being filled with top filling fluid from the outlet. The at least one gas vent channel may define the outlet contact element, or portion thereof.

The outlet may comprise a guide. The guide may be configured to guide vacating gas, vacating from a gas vent channel, outside a tubular in a downwardly parallel direction relative to the axial length of a tubular. The guide may be configured to be affixed to the edge region of the outlet. The guide may be detachable with the outlet (e.g. so as to be replaceable).

According to a fourth aspect of the invention there is provided a first filter region for an apparatus for use in top filling of tubulars, the first filter region configured to be in fluid communication with an inlet for providing top filling fluid from a top drive, and fluid communication with an outlet for providing top filling fluid to a tubular, the first filter region comprising a plurality of apertures configured to remove debris from a top filling fluid flowing from an inlet to an outlet.

According to a fifth aspect of the invention there is provided a filter configuration for an apparatus for use in top filling of tubulars, the filter configuration configured for attachment with an inlet for providing top filling fluid from a top drive, and attachment with an outlet for providing top filling fluid to a tubular, wherein the filter configuration comprises a first filter region configured to be in fluid communication with an inlet and a second filter region configured to be in fluid communication with an outlet, and wherein the first and second fluid regions are in fluid communication via a plurality of restrictive apertures, the plurality of restrictive apertures configured to remove debris from a top filling fluid flowing from the first filter region to the second filter region.

According to a sixth aspect of the invention there is provided a top filling drill system, the top filling drill system comprising at least one tubular for use with a drill bore, a top drive for providing top filling fluid, and an apparatus according to any of the features of the first aspect.

According to a seventh aspect there is provided a drill platform/deck comprising a top filling drill system according to the sixth aspect.

According to an eighth aspect there is a method of top filling of tubulars, the method comprising:

- mating an inlet with a top drive for providing top filling fluid;
- mating an outlet with a tubular for being top filled;
- providing the inlet with top filling fluid;
- filtering the top filling fluid between the inlet and the outlet so as to remove debris from the top filling fluid; and
- top filling the tubular with filtered top filling fluid from the outlet.

The method may comprise sealing the inlet with the top drive. The method may comprise sealing the inlet with a filter configuration for filtering. The method may comprise filtering the top filling fluid such that it does not restrict (e.g. unduly restrict) the flow of top filling fluid from the inlet to the outlet. The method may comprise using pressurised top filling fluid.

The method may comprise mating the outlet with the tubular so as not to provide sealing.

The method may comprise sealing the outlet with the tubular.

The method may comprise filtering the top filling fluid flow by using a filter configuration comprising a plurality of restrictive apertures.

The method may comprise removing debris from the filter configuration after debris has accumulated. The method may comprise replacing a filter configuration for filtering top filling fluid (or portion thereof) after use, or from time to time (i.e. periodically, aperiodically, after corrosion, erosion, ablation, etc.).

The method may comprise inverting a first configuration (i.e. tipping upside down) so remove accumulated debris.

According to a ninth aspect there is provided a method of top filling of tubulars, the method comprising:

- positioning an outlet of an apparatus on a tubular, the apparatus for fluid communication with a top drive for providing top filling fluid via an inlet, and for fluid communication with the tubular via the outlet;
- bringing a top drive into fluid communication with the inlet of the apparatus;
- providing top filling fluid to the tubular through the apparatus from the top drive; and
- filtering the top filling fluid by using a filter configuration of the apparatus, the filter configuration configured between the inlet and outlet.

The method may comprise removing the top drive from the apparatus, typically simply by raising the top drive out of contact with the apparatus. The method may comprise removing the top drive from the apparatus and removing the apparatus from the tubular after the tubular has been top filled. The positioning/removing of the apparatus may be by hand (e.g. a user may be able to pick-up/place the apparatus by hand).

According to a tenth aspect of the invention there is provided a means for top filling tubulars, the means for top filling tubulars comprising an means for communicating fluid from a means for providing top filling fluid, and a means for communicating fluid to a tubular, wherein the means for top filling tubulars comprises a means for filtering, the means for filtering in fluid communication with the means for communicating fluid from a means for providing top filling fluid, and in fluid communication with the means for communicating fluid to a tubular, wherein the means for filtering is configured to remove debris from a top filling fluid flow flowing from the means for communicating fluid from a means for providing top filling fluid to the means for communicating fluid to a tubular during top filling of a tubular.

According to a eleventh aspect of the invention there is provided an means for communicating fluid configured for attachable/detachable use with a means for removing debris from a top filling fluid, the means for communicating fluid configured for fluid communication with a means for providing top filling fluid and configured for fluid communication with a means for removing debris from a top filling fluid, the means for communicating fluid for use in top filling of a tubular.

According to a twelfth aspect of the invention there is provided an means for communicating fluid configured for attachable/detachable use with a means for removing debris from a top filling fluid, the means for communicating fluid configured for fluid communication with a tubular for being provided with top filling fluid and for fluid communication with a means for removing debris from a top filling fluid, the means for communicating fluid for use in top filling of a tubular.

According to a thirteenth aspect of the invention there is provided a means for filtering for a means for top filling of tubulars, the means for filtering configured for attachment with an means for communicating fluid for providing top filling fluid from a means for providing top filling fluid, and attachment with an means for communicating fluid for providing top filling fluid to a tubular, wherein the means for filtering comprises a first means for filtering configured to be in fluid communication with means for communicating fluid for providing top filling fluid and a second means for filtering configured to be in fluid communication with an means for communicating fluid for providing top filling fluid to a tubular, and wherein the first and second means for filtering are in fluid communication via a plurality of means for removing debris, the plurality of means for removing debris configured to remove debris from a top filling fluid flowing from the first means for filtering to the second means for filtering.

According to a fourteenth aspect of the invention there is provided a means for drilling, the means for drilling comprising at least one tubular for use with a drill bore, a means for providing top filling fluid, and a means for top filling tubulars according to the twelfth aspect.

The invention includes one or more corresponding aspects, embodiments or features in isolation or in various combinations whether or not specifically stated (including claimed) in that combination or in isolation. It will be appreciated that one or more embodiments/aspects may be useful in top filling tubulars.

The above summary is intended to be merely exemplary and non-limiting.

BRIEF DESCRIPTION OF THE FIGURES

A description is now given, by way of example only, with reference to the accompanying drawings, in which.

DESCRIPTION OF SPECIFIC EMBODIMENTS

Figure 1:
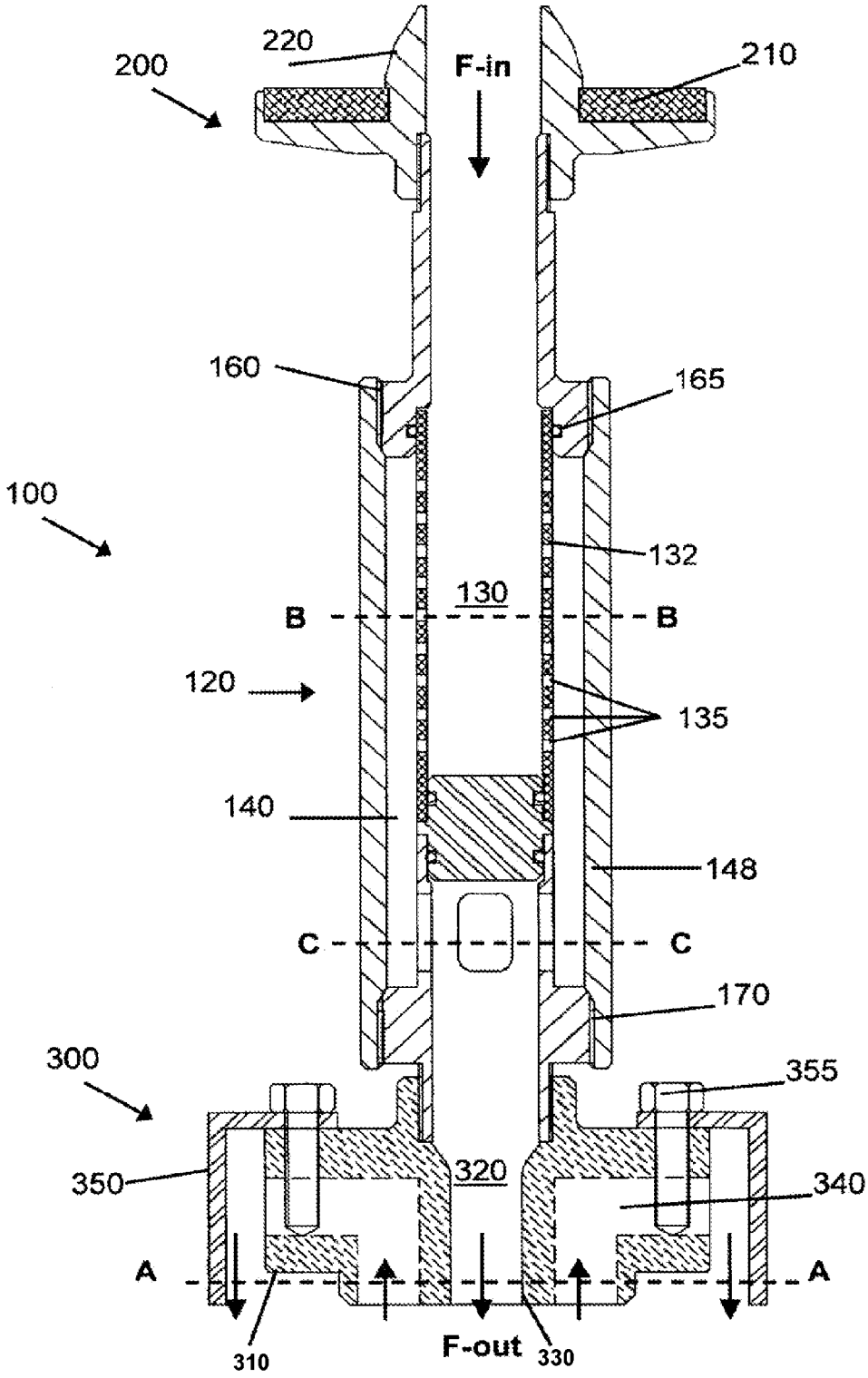
FIG. 1 shows a cross-section of an embodiment of an apparatus for top filling a tubular.

FIG. 1 shows a cross-section of apparatus 100 according to an embodiment of the invention. The apparatus 100 comprises an inlet 200, an outlet 300 and a filter configuration 120.

The inlet 200 is detachably connected to the filter configuration 120 and is configured to allow for passing of top filling fluid (e.g. mud, brine, etc.) from the inlet 200 to the filter configuration 100. The outlet 300 is detachably connected to the filter configuration 120 and allows for top filling fluid to be passed from the filter configuration to the outlet 300 (i.e. after top filling fluid has been passed from the inlet 200 to the filter configuration 120). When attached the inlet 200 is fluidly sealed with the filter configuration 120. Similarly, when attached, the outlet is fluidly sealed with the filter configuration 120. Here, the apparatus is configured to be pressurised by top filling fluid.

The inlet 200/outlet 300 are detachably connected to the filter configuration 120 by complementary screw/thread arrangements 160, 170, although other connections may be used such as interference fits, inter-engaging elements, etc. In alternative embodiments, the inlet 200/outlet 300 may not be detachable, for example, provided integrally (e.g. integrally sealed).

The inlet 200 is provided with an inlet sealing element 210, which in this embodiment takes the form of an annular gasket. The inlet sealing element 210 comprises a deformably resilient material (e.g. an elastomer, rubber, etc.) to provide for sealing of the inlet with a top drive system (top drive—not shown) for providing top filling fluid. The inlet sealing element 210 is configured to make mating contact (e.g. non-fixed contact) with a top drive for providing the top filling fluid.

The inlet 200 further comprises a tapered region 220. The tapered region 220 is configured to be located within a saver-sub 400 of a top drive and attachable and detachable from the saver-sub 400. The tapered region 220 is configured so as to allow for ease of positioning of the inlet 200 with respect to a top drive/saver-sub 400 for providing top filling fluid (i.e. ease of positioning by a user). "F-in" indicates the direction of top filling fluid entering the inlet 200.

The outlet 300 comprises an outlet contact element 310 and a nozzle portion 320. The outlet contact element 310 is provided by an annular element. The outlet contact element 310 is configured for mating contact (i.e. non-fixed contact) allowing attachment and detachment with a tubular 500 for top filling (e.g. for mating contact with a drill pipe, completion tube, casing, liner, etc.).

The nozzle portion 320 comprises a nozzle 330 for injecting/directing top filling fluid from the outlet 300 into tubular 500. "F-out" indicates the direction of top filling fluid exiting the outlet 300. In some embodiments, the nozzle 330 is configured to provide a jet of fluid flow that is narrower than the uppermost narrowest constriction of the tubular 500 (e.g. the diameter of the flow of fluid coming from the nozzle 330 is less that the diameter of an uppermost constriction at an upper region of the tubular 500, such as the uppermost constriction observed on some drill pipes, or the like). Such a configuration provides for fast and controlled filling of the tubular 500 with top filling fluid.

That is to say that the nozzle 330 provides a particular constricted flow of top filling fluid, when compared to the flow being provided by a top drive. Here, the flow "F-out" exits the nozzle 330 is a longitudinal direction only. Here, there is provided a single nozzle, but it will be appreciated that a plurality of nozzles 330 may provide the same/similar effect.

It will be appreciated that the outlet contact element 310 additionally serves to locate the nozzle 330 in a particular location relative to a tubular. Here, the outlet contact element 310 serves to position the nozzle 330 such that it is axially aligned with the tubular 500.

The nozzle portion 320 further comprises a plurality of gas vent channels 340, which are configured to allow vacating gas from the tubular 500 to escape from the outlet 300/tubular 500 (i.e. gas being pushed out of the tubular 500 by the ingress of top filling fluid from the nozzle 330 is permitted to escape from the outlet 300 by way of the gas vent channels 340). In the present embodiment, the outlet 300 comprises six gas vent channels 340, which extend radially from the outlet 300. Here, the gas vent channels 340 are evenly distributed around the periphery of the outlet 300.

A skilled reader will appreciate that, in this embodiment, the outlet 300 is configured to be 'sealed' with the tubular 500. However, in alternative embodiments that need not be the case (i.e. the outlet 300/apparatus 100 may not be configured to be sealed with a tubular by providing gas vent channels 340).

That is to say that by providing gas vent channel(s) 340, the apparatus may be configured to top fill tubulars for circulating drilling fluid, etc.

Here, the outlet 300 further comprises a depending annular skirt (i.e. a depending skirt/shroud), which is configured as a guide 350. The guide 350 is configured to guide vacating gas outside a tubular (i.e. gas that has passed through the gas vent channels 340) in a downwardly parallel direction relative to the axial length of the tubular 500 (i.e. directing vacating gas down to the slips).

It will readily be appreciated that such an arrangement provides that any vapour droplets (e.g. vapour droplets of mud, brine, etc.) that are caught/carried in the egressing gas are directed away (i.e. safely/cleanly away) from users of the apparatus 100.

In alternative embodiments, the guide 350 may be provided by another configuration, such as channels or the like and not a skirt (e.g. a single skirt/shroud), as will be appreciated.

The guide 350 is configured to be attachable to the outlet 300. The guide 350 is attached to the outlet 300 by affixing bolts 355. FIG. 2*a* shows a cross-section of the outlet 300 at A-A without the guide 350.

The filter configuration 120 comprises a first filter region 130 and a second filter region 140. The first filter region 130 is in fluid communication with the inlet 200, and in fluid communication with the second filter region 140, via a plurality of restrictive apertures 135. The second filter region 140 is in fluid communication with the outlet 300.

The first filter region 130/inlet 200 are configured such that a user may visually inspect the first filter region 130 via the inlet 200 (i.e. visually inspect to see if there is any debris to be removed). Here, the first filter region 130/inlet 200 are configured such that the apparatus 100 may be turned upside down, if desired, so as to remove debris. Additionally, a user may introduce a hand/arm/tool into the inlet 200/first filter region 130 to remove debris.

In the present embodiment, the restrictive apertures 135 are configured on a peripheral wall 132 defining the first filter region 130 (i.e. the peripheral wall 132 serves to define openings that act as the restrictive apertures 135).

The first filter region 130 is configured to be cylindrical. Each restrictive aperture 135 extends transversely thought the peripheral wall 132 of the first filter region 130 with respect to the direction of top filling fluid flow from the inlet 200. Each restrictive aperture 135 extends radially through the peripheral wall 132 of the first filter region 130.

The restrictive apertures 135 are configured along a length of the wall 132 defining the first filter region 130 (i.e. they extend along the principal/axial length of the wall 132 of the first filter region 130). Here, the restrictive apertures 135 are evenly distributed in the direction that top filling fluid is intended to enter the first filter region 130. The first filter region 130 is configured such that debris collected at the distal end of the first filter region 130 (e.g. the end of the first filter region 130 furthest from the inlet 200), does not hinder (i.e. by accumulating/blocking) top filling fluid from passing from the first filter region 130 to the second filter region 140 via restrictive apertures 135 that are closer to the proximal end of the first filter region 130 (e.g. the end of the first filter region closest to the inlet 200).

Figure 2B:
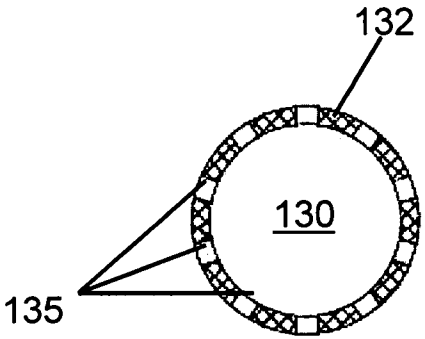
FIG. 2 show particular cross-sections of the apparatus shown in FIG. 1.
Figure 2C:
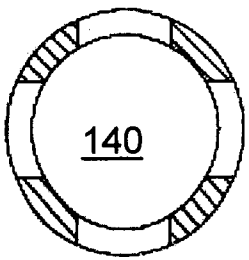
Figure 2A:
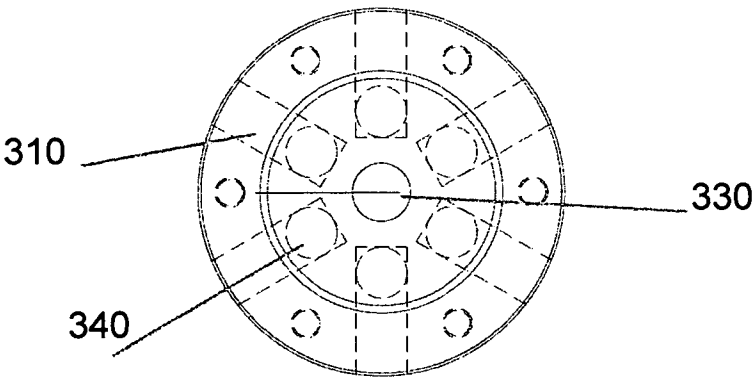

FIG. 2*b* shows a cross-section of the restrictive apertures 135 at B-B, while FIG. 2*c* shows a cross-section of the filter configuration at 120 at C-C.

The restrictive apertures 135 are configured such that they do not unduly hinder flow of top filling fluid flowing from the inlet 200 to the outlet 300 (i.e. by their number/orientation/cumulative cross-sectional area).

The restrictive apertures 135 are configured, in use, to remove debris from top filling fluid passing from the inlet 200 to the outlet 300. It will readily be appreciated that in some embodiments, the restrictive apertures may be evenly displaced, unevenly displaced, or a combination of evenly and unevenly displaced. Similarly, that the size of some or all of the restrictive apertures 135 may be uniform, or may vary in size. A skilled reader will appreciate that this may be dependent upon the particular debris intended to be trapped (e.g. a colander configuration with relatively coarsely defined restrictive apertures, or sieve configuration with relatively finely defined restrictive apertures 135, or combination of both).

The second filter region 140/outlet 300 are configured such that top filling fluid passing through the filter configuration 120/outlet 300 is output in substantially the same direction as that entering the inlet 200.

Here, an outer wall of the second filter region 140 defines an outer casing 148 of the apparatus 100. The inlet 200 and the outlet 300 are configured for attachment with the casing 148. When the inlet and the outlet are positioned with the casing 148, the inlet 200 and outlet 300 serve to communicate with the first filter region 130. That is that in this embodiment, the inlet 200 and outlet 300 serve to hold the first filter region 130 in position. The casing is further configured such that a user may lift/move/grab, etc. the casing by hand for ease of use/transport.

The inlet 200 helps maintain the first filter region in position by an annular O-ring 165. When the inlet 200 is removed/detached, the apparatus 100 is configured such that the first filter region 130 can be removed from the apparatus 100/casing 148. The O-ring 165 allows for the first filter region 130 comprising the restrictive apertures 135 to be detached (e.g. for replacement/easy removal of debris), such as detached by a user.

It will be appreciated that, as shown here, the first filter region 130 may additionally/alternatively be removed by detaching the outlet 300.

In use, a user positions a particular tubular 500 in a drill bore (e.g. drill piping, completion tubing, casing, liner, etc.) for top filling with top filling fluid (such as mud, brine, etc.). The user then positions the outlet contact element 310 of the outlet 300 on an upper peripheral rim of the tubular to be filled (e.g. so as to contact the outlet contact element 310 with the tubular 500—the outlet 300 not being sealed with the tubular 500 due to the gas vent channels 340).

A user is then able to bring a top drive into contact with the inlet sealing element 210 of the inlet 200. This positioning is assisted by the tapered region 220 of the inlet 200, although in some embodiments, the inlet 200 may not comprise the tapered region 220. In some instances, the weight of a top drive bearing on the inlet sealing element 210 is sufficient to provide a sealing contact. In other instances, users may provide extra force to provide sealing contact (e.g. by using weights, or by forcing the top drive against the inlet 200). It will readily be appreciated that, in the present embodiment, any force applied by a top drive to the inlet 200 will also act to provide a force to contact/locate the outlet 300 with a tubular.

After the apparatus 100 has been positioned, top filling fluid may be pumped through the inlet 200 from a top drive to the first filter region 130 of the apparatus 100. Debris in the top filler fluid is then inhibited from passing through to the second filter region 140 by the restrictive apertures 135. It will readily be appreciated that due to the configuration of the first filter region 130/restrictive apertures 135 of the present embodiment (i.e. the restrictive apertures 135 extending along a length of the first filter region 135), debris has a tendency to be trapped by the lower, distal, restrictive apertures 135. This may, in some cases, cause these particular restrictive apertures 135 to become blocked. However, other upper, proximal, restrictive apertures 135 remain free of debris so as to provide for filtering of the top filling fluid entering the first filter region 130. It will readily be appreciated that the first filter region 130 may be considered to act as a trap for debris.

It will also be appreciated that as the inlet 200 is sealed with the top drive, and the filter configuration 120, that the first filter region 130 does not act to unduly hinder the flow rate. That is to say that the pressure is sufficient to force the top filling fluid through the restrictive apertures 135, which would not have occurred had the inlet not been sealed with the filter configuration.

The filtered top filling fluid is then passed to the second filter region 140, and then to the outlet. The top filling fluid is then passed the nozzle 330 and directed into tubular 500 in order to provide for filling of the tubular 500 with filtered top filling fluid. Due to the particular configuration of the nozzle 330, as the filtered top filling fluid enters tubular 500, vacating gas is allowed to escape via the gas vent channels 340, and in this embodiment, is directed in a downwardly direction by the guide 350. The guide 350 may help to reduce the chance of injury to a user from contaminants/particulates being ejected along with the vacating gas. The guide reduces the chance of a user (and/or equipment) being splashed by any liquid comprised with gas (e.g. vapour droplets of mud, brine, etc.).

The nozzle 330/gas vent channels 340 allow for relatively fast flow rates of top filling fluid to be injected/directed into a tubular. Here, the use of the filter configuration 120 means that this flow rate need not be reduced to account for the time taken for top filling fluid passing normally through an "open air" filter.

After particular tubular(s) 500 have been filled, a user may remove the bearing/weight of a top drive on the inlet 200 and remove the apparatus 100 for its position (e.g. remove by hand).

If required, a user may detach the first filter region 130 and the inlet 200 by way of the engagement regions 160/O-ring 165 to allow for ease of removal of debris from the first filter region 130. Such detachment may also allow the first filter region 130. In some embodiments, the first filter region 130 may be considered to be a replaceable filter element. Alternatively, the user may invert the apparatus 100 (i.e. turn it upside down) to remove debris. Alternatively, the user may introduce an arm/hand/tool into the first filter region from the inlet 200 so as to remove debris (i.e. without detachment).

It will readily be appreciated by the skilled reader that in some instances the apparatus 100/filter configuration 120 may be used with a number of different inlets 200/outlets 300. For example, a user may select a particular outlet 300 comprising a particular outlet contact element 340 that is configured for mating with a particular tubular. Similarly, a particular inlet 200 may be provided for a particular top drive configuration.

It will be appreciated that any of the aforementioned apparatus 100, filter configuration 120, inlet 200, outlet 300, may have other functions in addition to the mentioned functions, and that these functions may be performed by the same apparatus/elements.

In addition, and in view of the foregoing description, it will be evident to a person skilled in the art that various modifications to either embodiment may be made within the scope of the invention.

While it has been shown and described a particular embodiment of the invention, it will be understood that various omissions, substitutions and/or changes in the form and details of the apparatus, etc., and methods described may be made by those skilled in the art without departing from the spirit of the invention.

For example, it is expressly intended that all combinations of those elements and/or method steps which perform substantially the same function in substantially the same way to achieve the same results are within the scope of the invention. Moreover, it should be recognised that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses (if used) are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. An apparatus for use in top filling of tubulars, the apparatus configured for temporary location between a saver-sub of a top drive and a tubular only for the duration of a top filling operation, the apparatus having an inlet configured for mounting and demounting to an outlet of the saver-sub and an outlet configured for mounting and demounting to the tubular, the inlet for fluid communication with the outlet of the saver-sub for providing top filling fluid, and the outlet for fluid communication with the tubular, wherein the apparatus comprises a filter configuration, in fluid communication with the apparatus inlet and the apparatus outlet and configured to remove debris from a top filling fluid flow flowing from the apparatus inlet to the apparatus outlet during top filling of the tubular.

2. An apparatus according to claim 1, wherein the filter configuration is fluidly sealed with respect to the inlet and/or outlet.

3. An apparatus according to claim 1, wherein the apparatus is configured such that the inlet is sealable with respect to the outlet of the saver-sub.

4. An apparatus according to claim 1 wherein the apparatus is configured to be pressurised.

5. An apparatus according to claim 1, wherein the inlet comprises an inlet sealing element, configured to allow for non-fixed mating of the outlet of the saver-sub with the inlet.

6. An apparatus according to claim 5, wherein the sealing element provides for sealing of apparatus/inlet and a saver-sub of a top drive.

7. An apparatus according to claim 5 wherein the inlet sealing element comprises a material selected from the group consisting of: an elastomer material; a rubber material; or a silicon material.

8. An apparatus according to claim 1, wherein the inlet comprises a tapered region, the tapered region configured to allow for ease of positioning of the inlet with respect to the outlet of the saver-sub.

9. An apparatus according to claim 1, wherein the outlet comprises a nozzle portion, the nozzle portion comprising a nozzle configured to guide and direct top filling fluid into a tubular.

10. An apparatus according to claim 9, wherein the nozzle portion further comprises at least one gas vent channel, the at least one gas vent channel configured to allow vacating gas to exit a tubular/outlet when a tubular is being filled with top filling fluid from the outlet.

11. An apparatus according to claim 10, wherein the outlet comprises a guide, the guide configured to guide vacating gas, vacating from a gas vent channel, outside a tubular in a downwardly parallel direction relative to the axial length of a tubular.

12. An apparatus according to claim 11 wherein the guide configured to be detachably affixed to the edge region of the outlet.

13. An apparatus according to claim 1, wherein the outlet comprises an outlet contact element, the outlet contact element configured to provide for non-fixed mating of the outlet and a tubular.

14. An apparatus according to claim 1, wherein the filter configuration comprises a first filter region in fluid communication with the inlet and a second filter region in fluid communication with the outlet, the first filter region being in fluid communication with the second filter region via a plurality of restrictive apertures, the restrictive apertures configured to remove debris from a top filling fluid flow flowing from the inlet to the outlet.

15. An apparatus according to claim 14, wherein the restrictive apertures are configured so that the cumulative cross-sectional area of the restrictive apertures is substantially the same, or greater, that the cross-sectional area of the inlet and the first filter region.

16. An apparatus according to claim 14 wherein the first filter region is configured as a user assessable trap for trapping debris within the first filter region.

17. An apparatus according to claim 14, wherein the first filter region is removable from the apparatus to allow for easy removal of debris.

18. An apparatus according to claim 14, wherein the first filter region is attachable/detachable with the inlet and/or second filter region so as to be removable/replaceable.

19. An apparatus according to claim 14, wherein the apparatus is configured such that the first filter region is retained/held between the inlet and outlet.

20. An apparatus according to claim 14, wherein some or all of the restrictive apertures are provided along a wall defining the first filter region and extend in the direction that top filling fluid is intended to enter the first filter region.

21. An apparatus according to claim 1, wherein the apparatus is configured to allow a user to invert the apparatus so as to facilitate removal of debris from the filter configuration.

22. An apparatus according to claim 1 wherein the apparatus is configured such that flow of top filling fluid entering from the inlet is in substantially the same direction as flow exiting from the outlet.

23. An apparatus according to claim 1 wherein the inlet and outlet are attachable and detachable with the apparatus.

24. An apparatus according to claim 1 configured for top filing a tubular selected from the group consisting of: drill piping; completion tubing; casing; or liners.

25. A top filling drill system, the top filling drill system comprising at least one tubular for use with a drill bore, a top drive for providing top filling fluid, the saver-sub, and an apparatus according to claim 1.

26. A drill platform or deck comprising a top filler device/top filling drill system according to claim 25.

27. A method of top filling of tubulars, the method comprising:

temporarily locating an apparatus between a saver-sub of a top drive for providing top filling fluid and a tubular for being top filled;

mating an inlet of the apparatus to an outlet of the saver-sub of the top drive;

mating an outlet of the apparatus to the tubular;

providing the inlet of the apparatus with top filling fluid from the outlet of the saver-sub;

filtering the top filling fluid between the inlet of the apparatus and the outlet of the apparatus so as to remove debris from the top filling fluid; and top filling the tubular with filtered top filling fluid from the outlet of the apparatus.

28. A method according to claim 27, wherein the method comprises fluidly sealing a filter configuration with respect to the inlet of the apparatus for filtering the top filling fluid.

29. A method according to claim 27, wherein the method comprises sealing the inlet with the saver-sub of the top drive.

30. A method of top filling of tubulars, the method comprising:

positioning an outlet of a top filling apparatus on the upper end of a tubular, the apparatus for fluid communication with an outlet of a saver-sub of a top drive for providing top filling fluid via an inlet of the apparatus, and for fluid communication with the tubular via the outlet of the apparatus;

bringing the outlet of the saver-sub into fluid communication with the inlet of the apparatus;

providing top filling fluid to the tubular through the apparatus from the saver-sub of the top drive; and filtering the top filling fluid by using a filter configuration of the apparatus, the filter configuration configured between the inlet of the apparatus and outlet of the apparatus.

31. A method according to claim 30 wherein the method comprises removing the saver-sub of the top drive from the apparatus and removing the apparatus from the tubular after the tubular has been top filled.

32. A method according to claim 30 wherein positioning/removing of the apparatus is by hand.

* * * * *